US007448216B2

(12) United States Patent
McCaffrey et al.

(10) Patent No.: US 7,448,216 B2
(45) Date of Patent: Nov. 11, 2008

(54) METHODS AND APPARATUS FOR OPERATING GAS TURBINE ENGINE COMBUSTORS

(75) Inventors: Timothy P. McCaffrey, Swampscott, MA (US); Stephen John Howell, West Newbury, MA (US); John Carl Jacobson, Melrose, MA (US); Barry Francis Barnes, Malden, MA (US)

(73) Assignee: General Electric Company, Schenectady, NY (US)

( * ) Notice: Subject to any disclaimer, the term of this patent is extended or adjusted under 35 U.S.C. 154(b) by 216 days.

(21) Appl. No.: 11/428,761

(22) Filed: Jul. 5, 2006

(65) Prior Publication Data

US 2006/0288704 A1 Dec. 28, 2006

Related U.S. Application Data

(62) Division of application No. 10/613,641, filed on Jul. 2, 2003, now Pat. No. 7,093,419.

(51) Int. Cl.
*F02C 7/26* (2006.01)

(52) U.S. Cl. ..... 60/772; 60/39.826; 60/39.094

(58) Field of Classification Search ..... 60/778, 60/786, 39.826, 772, 39.094
See application file for complete search history.

(56) References Cited

U.S. PATENT DOCUMENTS

| | | | | |
|---|---|---|---|---|
| 3,034,297 | A * | 5/1962 | Orchard et al. | 60/747 |
| 3,116,606 | A * | 1/1964 | Dougherty et al. | 60/39.826 |
| 3,283,502 | A * | 11/1966 | Lefebvre | 60/739 |
| 3,990,834 | A * | 11/1976 | DuBell et al. | 431/264 |
| 4,584,834 | A * | 4/1986 | Koshoffer et al. | 60/737 |
| 4,696,619 | A | 9/1987 | Lardellier | |
| 4,817,389 | A * | 4/1989 | Holladay et al. | 60/739 |
| 5,228,828 | A | 7/1993 | Damlis et al. | |
| 5,906,473 | A | 5/1999 | Sexton et al. | |
| 6,065,281 | A * | 5/2000 | Shekleton et al. | 60/39.094 |
| 6,530,223 | B1 | 3/2003 | Dodds et al. | |
| 6,886,343 | B2 | 5/2005 | Manteiga et al. | |
| 6,955,038 | B2 | 10/2005 | McCaffrey et al. | |
| 6,976,363 | B2 | 12/2005 | McMasters et al. | |
| 7,051,532 | B2 | 5/2006 | Howell et al. | |
| 7,093,419 | B2 | 8/2006 | McCaffrey et al. | |

* cited by examiner

*Primary Examiner*—Ted Kim
(74) *Attorney, Agent, or Firm*—William Scott Andes; Armstrong Teasdale LLP

(57) ABSTRACT

A method facilitates assembling a gas turbine engine. The method comprises coupling a combustor including a dome assembly and a combustor liner that extends downstream from the dome assembly to a combustor casing that is positioned radially outwardly from the combustor, coupling a ring support that includes a first radial flange, a second radial flange, and a plurality of beams that extend therebetween to the combustor casing, and coupling a primer nozzle including an injection tip to the combustor such that the primer nozzle extends axially through the dome assembly such that fuel may be discharged from the primer nozzle into the combustor during engine start-up operating conditions.

6 Claims, 3 Drawing Sheets

METHODS AND APPARATUS FOR OPERATING GAS TURBINE ENGINE COMBUSTORS

CROSS-REFERENCE TO RELATED APPLICATIONS

This application is a divisional of U.S. patent application Ser. No. 10/613,641, filed on Jul. 2, 2003, now U.S. Pat. No. 7,093,419, which is hereby incorporated by reference and is assigned to assignee of the present invention.

STATEMENT REGARDING FEDERALLY SPONSORED RESEARCH OR DEVELOPMENT

The U.S. Government may have certain rights in this invention pursuant to contract number DAAE07-00-C-N086.

BACKGROUND OF THE INVENTION

This invention relates generally to gas turbine engines, more particularly to combustors used with gas turbine engines.

Known turbine engines include a compressor for compressing air which is suitably mixed with a fuel and channeled to a combustor wherein the mixture is ignited for generating hot combustion gases. The gases are channeled to at least one turbine, which extracts energy from the combustion gases for powering the compressor, as well as for producing useful work, such as propelling a vehicle.

To support engine casings and components within harsh engine environments, at least some known casings and components are supported by a plurality of support rings that are coupled together to form a backbone frame. The backbone frame provides structural support for components that are positioned radially inwardly from the backbone and also provides a means for an engine casing to be coupled around the engine. In addition, because the backbone frame facilitates controlling engine clearance closures defined between the engine casing and components positioned radially inwardly from the backbone frame, such backbone frames are typically designed to be as stiff as possible.

At least some known backbone frames used with recuperated engines, include a plurality of beams that extend between forward and aft flanges. Because of space considerations, primer nozzles used with combustors included within such engines are inserted radially through a side of the combustor. More specifically, because of the orientation of such primer nozzles with respect to the combustor, fuel discharged from the primer nozzles enters the combustor at an injection angle that is approximately sixty degrees offset with respect to a centerline axis extending through the combustor. Accordingly, because of the orientation and relative position of the primer nozzle within the combustor, the primer nozzle is exposed to the combustor primary zone and must be cooled. Moreover, at least some known primer nozzles include tip shrouds which are also cooled and extend circumferentially around an injection tip of the primer nozzles. However, in at least some known primer nozzles, the cooling flow to the tip shrouds is unregulated such that if a shroud tip burns off during engine operation, cooling air flows unrestricted past the injection tip, and may adversely affect combustor and primer nozzle performance.

BRIEF DESCRIPTION OF THE INVENTION

In one aspect, a method for assembling a gas turbine engine is provided. The method comprises coupling a combustor including a dome assembly and a combustor liner that extends downstream from the dome assembly to a combustor casing that is positioned radially outwardly from the combustor, coupling a ring support that includes a first radial flange, a second radial flange, and a plurality of beams that extend therebetween to the combustor casing, and coupling a primer nozzle including an injection tip to the combustor such that the primer nozzle extends axially through the dome assembly such that fuel may be discharged from the primer nozzle into the combustor during engine start-up operating conditions.

In another aspect, a primer nozzle for a gas turbine engine combustor including a centerline axis is provided. The primer nozzle comprises an inlet, an injection tip, a body, and a shroud. The injection tip is for discharging fuel into the combustor in a direction that is substantially parallel to the gas turbine engine centerline axis. The body extends between the inlet and the injection tip. The body comprises at least one annular projection for coupling the nozzle to the body such that the primer nozzle is positioned relative to the combustor. The shroud extends around the injection tip and around at least a portion of the body such that a gap is defined between the shroud and at least one of the body and the injection tip. The shroud comprises a plurality of circumferentially-spaced openings for metering cooling air supplied to the injection tip.

In a further aspect, a combustion system for a gas turbine engine is provided. The combustion system comprises a combustor, a combustor casing, and a primer nozzle. The combustor includes a dome assembly and a combustor liner that extends downstream from the dome assembly. The combustor liner defines a combustion chamber therein. The combustor also includes a centerline axis. The combustor casing extends around the combustor. The primer nozzle extends axially into the combustor through the combustor casing and dome assembly for supplying fuel into the combustor along the combustor centerline axis during engine start-up operating conditions.

DETAILED DESCRIPTION OF THE INVENTION

Figure 1:
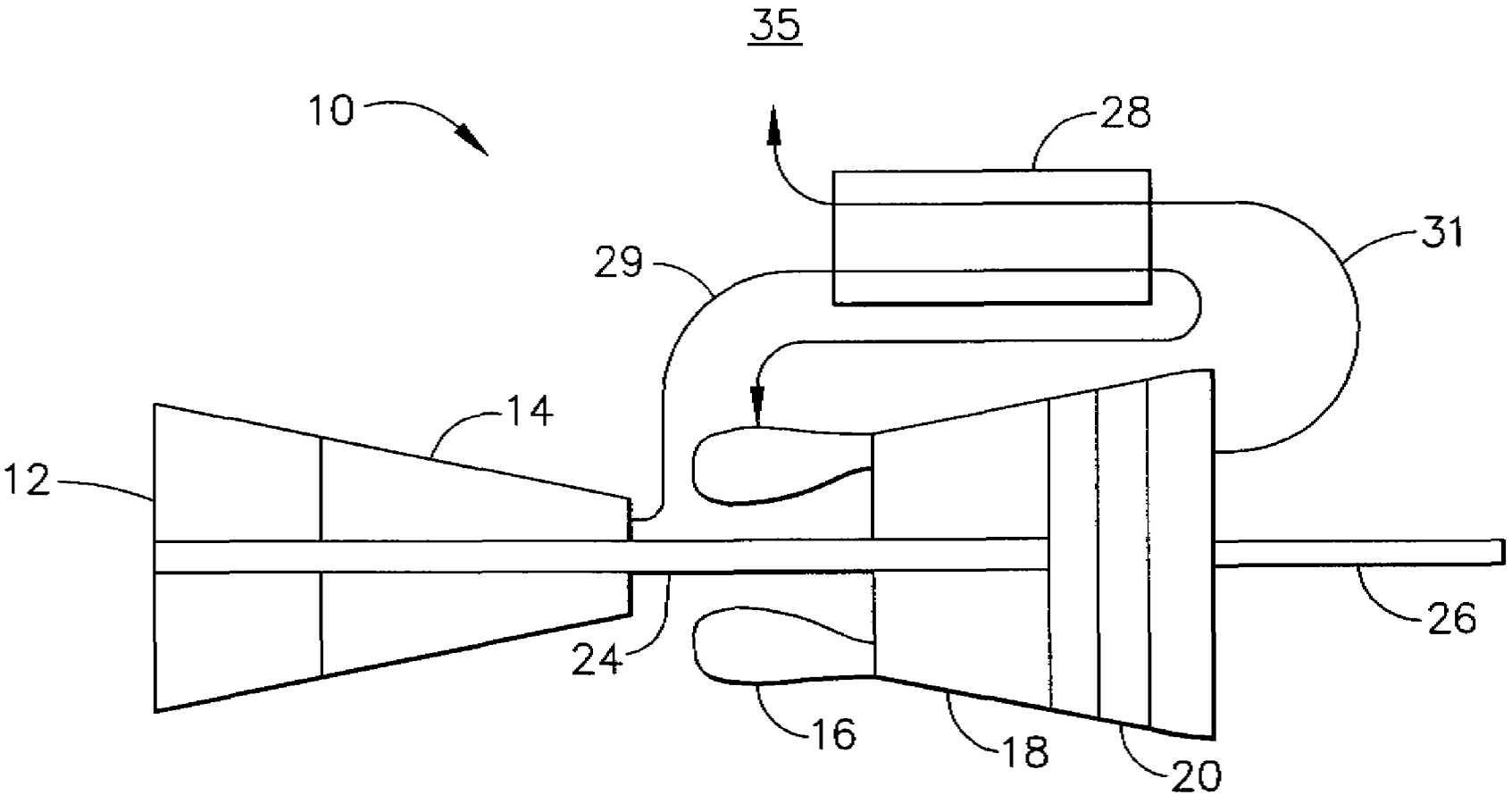
FIG. 1 is a schematic of a gas turbine engine.

FIG. 1 is a schematic illustration of a gas turbine engine 10 including a high pressure compressor 14, and a combustor 16. Engine 10 also includes a high pressure turbine 18 and a low pressure turbine 20. Compressor 14 and turbine 18 are coupled by a first shaft 24, and turbine 20 drives a second output shaft 26. Shaft 26 provides a rotary motive force to drive a driven machine, such as, but, not limited to a gearbox, a transmission, a generator, a fan, or a pump. Engine 10 also includes a recuperator 28 that has a first fluid path 30 coupled serially between compressor 14 and combustor 16, and a second fluid path 32 that is serially coupled between turbine 20 and ambient 34. In one embodiment, the gas turbine engine is an LV100 available from General Electric Company, Cincinnati, Ohio.

In operation, air flows through high pressure compressor 14. The highly compressed air is delivered to recuperator 28 where hot exhaust gases from turbine 20 transfer heat to the compressed air. The heated compressed air is delivered to combustor 16. Airflow from combustor 16 drives turbines 18 and 20 and passes through recuperator 28 before exiting gas turbine engine 10.

Figure 2:
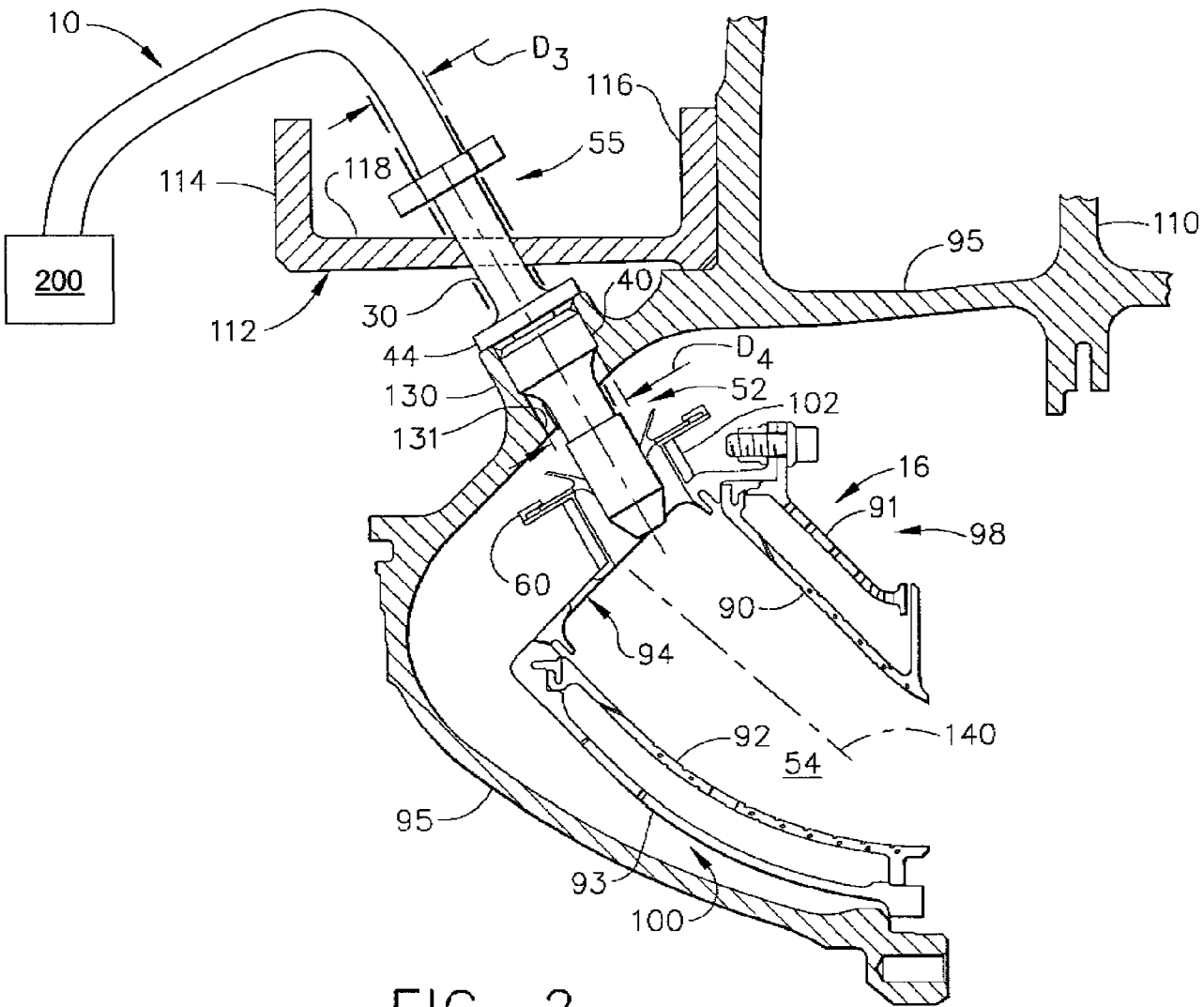
FIG. 2 is a cross-sectional illustration of a portion of the gas turbine engine shown in FIG. 1.
Figure 3:
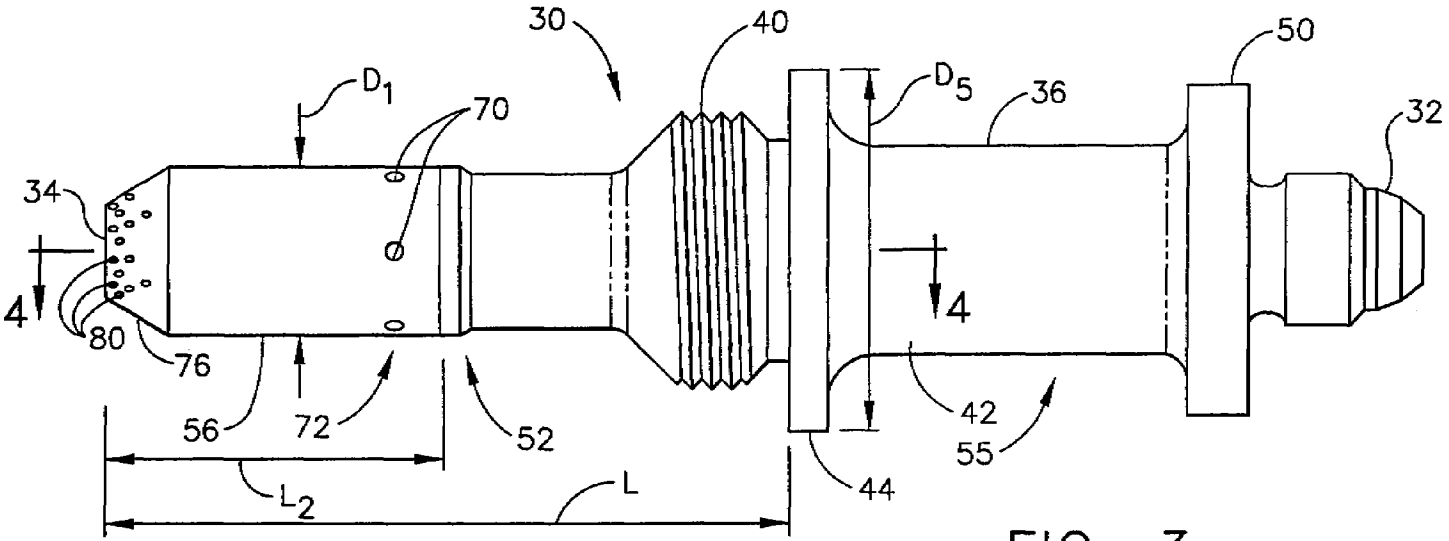
FIG. 3 is an enlarged side view of an exemplary primer nozzle used with the gas turbine engine shown in FIG. 2.
Figure 4:
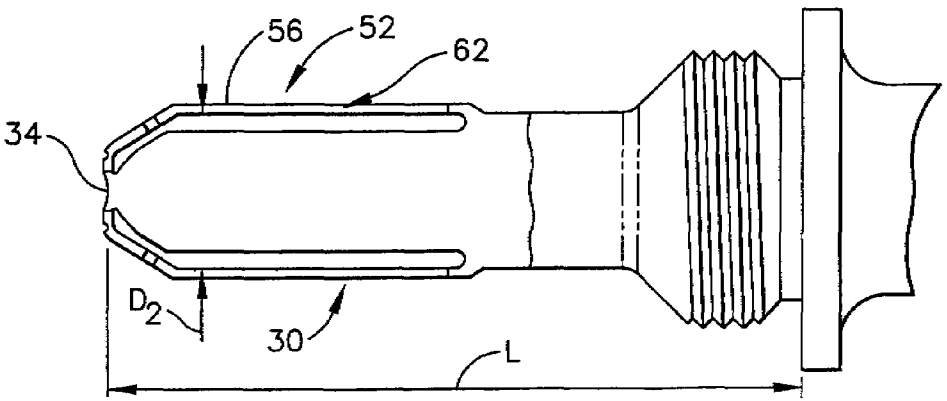
FIG. 4 is a cross-sectional view of a portion of the primer nozzle shown in FIG. 3 and taken along line 4-4.

FIG. 2 is a cross-sectional illustration of a portion of gas turbine engine 10 including a primer nozzle 30. FIG. 3 is an enlarged side view of primer nozzle 30. FIG. 4 is a cross-sectional view of a portion of primer nozzle 30 taken along line 4-4 (shown in FIG. 3). In the exemplary embodiment, primer nozzle 30 includes an inlet 32, an injection tip 34, and a body 36 that extends therebetween. Inlet 32 is a known standard hose nipple that is coupled to a fuel supply source and to an air supply source for channeling fuel and air into primer nozzle 30, as is described in more detail below. In addition, inlet 32 also includes a fuel filter (not shown) which strains fuel entering nozzle 30 to facilitate reducing blockage within nozzle 30.

In the exemplary embodiment, nozzle body 36 is substantially circular and includes a plurality of threads 40 formed along a portion of body external surface 42. More specifically, threads 40 enable nozzle 30 to be coupled within engine 10, and are positioned between injection tip 34 and an annular shoulder 44 that extends radially outward from body 36. Shoulder 44 facilitates positioning nozzle 30 in proper orientation and alignment with respect to combustor 16 when nozzle 30 is coupled to combustor 16, as described in more detail below. Nozzle body 36 also includes a plurality of wrench flats 50 that facilitate assembly and disassembly of primer nozzle 30 within combustor 16. In one embodiment, nozzle body 36 is machined to form flats 50.

Shoulder 44 separates nozzle body 36 into an internal portion 52 that is extended into combustor 16, and is thus exposed to a combustion primary zone or combustion chamber 54 defined within combustor 16, and an external portion 55 that is not extended into combustor 16. Accordingly, a length L of internal portion 52 is variably selected to facilitate limiting the amount of nozzle 30 exposed to radiant heat generated within combustion primary zone 54. More specifically, the combination of internal portion length L and position of shoulder 44 facilitates orienting primer nozzle 40 in an optimum position within combustor 16 and relative to a combustor igniter (not shown).

A shroud 56 extends circumferentially around injection tip 34 to facilitate shielding a injection tip 34 and a portion of internal portion 52 from heat generated within combustion primary zone 54. Specifically, shroud 56 has a length $L_2$ that is shorter than internal portion length L, and a diameter $D_1$ that is larger than a diameter $D_2$ of internal portion 52 adjacent injection tip 34. More specifically, shroud diameter $D_1$ is variably selected to be sized approximately equal to a ferrule 60 extending from combustor 16, as described in more detail below, to facilitate minimizing leakage from combustion chamber 54 between nozzle 30 and ferrule 60. Moreover, because shroud diameter $D_1$ is larger than internal portion diameter $D_2$, an annular gap 62 is defined between a portion of shroud 56 and nozzle body 36.

A plurality of metering openings 70 extend through shroud 56 and are in flow communication with gap 62. Specifically, openings 70 are circumferentially-spaced around shroud 56 in a row 72. Cooling air for shroud 56 is supplied though openings 70 which limit airflow towards shroud 56 in the event that a tip 76 of shroud 56 is burned back during combustor operations. In one embodiment, the cooling air supplied to shroud 56 is combustor inlet air which is circulated through recouperator 28 which adds exhaust gas heat into compressor discharge air before being supplied to combustor 16.

Shroud tip 76 is frusto-conical to facilitate minimizing an amount of surface area exposed to radiant heat within combustor 16. Moreover, a plurality of cooling openings 80 extending through, and distributed across, shroud tip 76 facilitate providing a cooling film across shroud tip 76 and also facilitate shielding injection tip 34 by providing an insulating layer of cooling air between shroud 56 and nozzle body 36 within gap 62.

Combustor 16 includes an annular outer liner 90, an outer support 91, an annular inner liner 92, an inner support 93, and a domed end 94 that extends between outer and inner liners 90 and 92, respectively. Outer liner 90 and inner liner 92 are spaced radially inward from a combustor casing 95 and define combustion chamber 54. Combustor casing 95 is generally annular and extends around combustor 16 including inner and outer supports, 93 and 91, respectively. Combustion chamber 54 is generally annular in shape and is radially inward from liners 90 and 92. Outer support 91 and combustor casing 95 define an outer passageway 98 and inner support 93 and combustor casing 95 define an inner passageway 100. Outer and inner liners 90 and 92 extend to a turbine nozzle (not shown) that is downstream from diffuser 48.

Combustor domed end 94 includes ferrule 60. Specifically, ferrule 60 extends from a tower assembly 102 that extends radially outwardly and upstream from domed end 94. Ferrule 60 has an inner diameter $D_3$ that is sized slightly larger than shroud diameter $D_1$. Accordingly, when primer nozzle 30 is coupled to combustor 16, primer nozzle 30 circumferentially contacts ferrule 60 to facilitate minimizing leakage to combustion chamber 54 between nozzle 30 and ferrule 60.

A portion of combustor casing 95 forms a combustor backbone frame 110 that extends circumferentially around combustor 16 to provide structural support to combustor 16 within engine 10. An annular ring support 112 is coupled to combustor backbone frame 110. Ring support 112 includes an annular upstream radial flange 114, an annular downstream radial flange 116, and a plurality of circumferentially-spaced beams 118 that extend therebetween. In the exemplary embodiment, upstream and downstream flanges 114 and 116 are substantially circular and are substantially parallel. Specifically, ring support 112 extends axially between compressor 14 (shown in FIG. 1) and turbine 18 (shown in FIG. 1), and provides structural support between compressor 14 and turbine 18.

A portion of combustor casing 95 also forms a boss 130 that provides an alignment seat for primer nozzle 30. Specifically, boss 130 has an inner diameter $D_4$ defined by an inner surface 131 of boss 130 that is smaller than an outer diameter $D_5$ of primer nozzle shoulder 44, and is larger than shroud diameter $D_1$. Inner surface 131 is threaded to receive primer nozzle threads 40 therein. Accordingly, when primer nozzle 30 is inserted through combustor casing boss 130, primer nozzle shoulder 44 contacts boss 130 to limit an insertion depth of primer nozzle internal portion 52 with respect to combustor 16. More specifically, shoulder 44 facilitates positioning primer nozzle 36 in proper orientation and alignment with respect to combustor 16 when primer nozzle 30 is coupled to combustor 16.

During assembly of engine 10, after combustor 16 is secured in position with respect to combustor casing 95, casing 95 is then coupled to ring support 112. Primer nozzle 30 is then inserted through combustor casing boss 130 and is coupled in position with respect to combustor 16. Specifically, nozzle external threads 40 are initially coated with a lubricant, such as Tiolube 614-19B, commercially available from TIODIZE®, Huntington Beach, Calif. Primer nozzle 30 is then threadably coupled to combustor boss 130 using wrench flats 50 that facilitate coupling/uncoupling primer nozzle 30 to combustor casing 95. Specifically, when primer nozzle 30 is coupled to combustor casing 95, nozzle 30 extends outward through ring support 112, and primer nozzle shroud 56 and injection tip 34 extend substantially axially through domed end 94. Accordingly, the only access to combustion chamber 54 is through combustor domed end 94, such that if warranted, primer nozzle 30 may be replaced without disassembling combustor 16.

During operation, fuel and air are supplied to primer nozzle 30. Specifically, combustor 16 requires the operation of primer nozzle 30 during cold operating conditions and to facilitate reducing smoke generation from combustor 16. More specifically, because of the orientation of primer nozzle 30 with respect to combustor domed end 94, fuel supplied to primer nozzle 30 is discharged with approximately a ninety-degree spray cone with respect to domed end 94 and along a centerline axis 140 extending from domed end 94 through combustor 16. As such, the direction of injection facilitates reducing a time for fuel ignition within combustion chamber 54. Accordingly, fuel discharged from primer nozzle 30 is discharged into combustion chamber 54 in a direction that is substantially parallel to centerline axis 140.

Accordingly, after engine 10 is started and idle speed is obtained, and during engine hot starts, fuel flow to primer nozzle 30 is stopped, which makes primer nozzles 30 susceptible to coking and tip burn back. To facilitate preventing coking within primer nozzles 30, nozzles 30 are substantially continuously purged with compressor bypass air supplied through an accumulator, to facilitate removing residual fuel from primer nozzle 30. Specifically, the operating temperature of the purge air is lower than an operating temperature of cooling air circulated through the recouperator and supplied to shroud 56. The purge air also facilitates reducing an operating temperature of primer nozzle 30 and injection tip 34 during engine operations when primer nozzle 30 is not employed.

The above-described combustion support provides a cost-effective and reliable means for operating a combustor including a primer nozzle. More specifically, the primer nozzle is inserted axially into the combustor through the combustor domed end such that fuel discharged from the primer nozzle is discharged into combustion chamber in a direction that is substantially parallel to the combustor centerline axis. The primer nozzle also includes a shroud that facilitates shielding the primer nozzle from high temperatures generated within the combustor. Moreover the shroud includes a plurality of metering openings that meter the cooling airflow to the primer nozzle in a cost-effective and reliable manner.

An exemplary embodiment of a combustion system is described above in detail. The combustion system components illustrated are not limited to the specific embodiments described herein, but rather, components of each combustion system may be utilized independently and separately from other components described herein. For example, each primer nozzle may also be used in combination with other engine combustion systems.

While the invention has been described in terms of various specific embodiments, those skilled in the art will recognize that the invention can be practiced with modification within the spirit and scope of the claims.

What is claimed is:

1. A method for assembling a gas turbine engine, said method comprising: coupling a combustor having a centerline axis and including a dome assembly and a combustor liner that extends downstream from the dome assembly to a combustor casing that is positioned radially outwardly from the combustor;

coupling a ring support that includes a first radial flange, a second radial flange, and a plurality of beams that extend therebetween to the combustor casing; and coupling a primer nozzle including an injection tip to the combustor such that the primer nozzle circumferentially contacts a ferrule extending upstream from the combustor, wherein the primer nozzle extends axially relative to the centerline axis through the dome assembly such that fuel may be discharged from the primer nozzle into the combustor during engine start-up operating conditions.

2. A method in accordance with claim 1 wherein coupling a primer nozzle including an injection tip to the combustor further comprises coupling a primer nozzle to the combustor such that fuel is discharged axially from the primer nozzle into the combustor in a direction that is substantially parallel to a centerline axis extending through the combustor.

3. A method in accordance with claim 1 wherein coupling a primer nozzle including an injection tip to the combustor further comprises coupling a primer nozzle to the combustor such that the primer nozzle extends through the ring support and includes a shroud that extends circumferentially around the primer nozzle injection tip.

4. A method in accordance with claim 1 wherein coupling a primer nozzle including an injection tip to the combustor further comprises coupling an air source to the primer nozzle such that cooling air supplied to the primer nozzle injection tip is metered by a plurality of openings extending through a shroud extending circumferentially around the primer nozzle injection tip.

5. A method in accordance with claim 1 further comprising coupling an air source to the primer nozzle to facilitate purging residual fuel from the primer nozzle into the combustor during pre-determined nozzle operations.

6. A method in accordance with claim 1 wherein coupling a primer nozzle including an injection tip to the combustor further comprises threadably coupling the primer nozzle to the combustor case such that a shoulder extending from the primer nozzle maintains the orientation of the primer nozzle with respect to the combustor.

* * * * *